United States Patent [19]

Burke

[11] 4,166,207

[45] Aug. 28, 1979

[54] MICROWAVE GENERATING DEVICE—DOOR SEAL

[75] Inventor: Harry D. Burke, Marion, Ohio

[73] Assignee: Whirlpool Corporation, Benton Harbor, Mich.

[21] Appl. No.: 801,833

[22] Filed: May 31, 1977

[51] Int. Cl.[2] ..... H05B 9/06

[52] U.S. Cl. ..... 219/10.55 D; 174/35 MS

[58] Field of Search ..... 219/10.55 D, 10.55 R; 174/35 GC, 35 MS, 35 R

[56] References Cited

U.S. PATENT DOCUMENTS

| | | | |
|---|---|---|---|
| 2,956,143 | 10/1960 | Schall | 219/10.55 D |
| 3,196,242 | 7/1965 | De Vries et al. | 219/10.55 D |
| 3,196,243 | 7/1965 | Schall | 219/10.55 D X |
| 3,242,303 | 3/1966 | Crapuchettes | 219/10.55 D |
| 3,304,401 | 2/1967 | Long | 219/10.55 D |
| 3,351,730 | 11/1967 | Pahlman | 219/10.55 D |
| 3,525,841 | 8/1970 | Haagensen et al. | 219/10.55 D |
| 3,544,751 | 12/1970 | Valles | 219/10.55 D |
| 3,576,417 | 4/1971 | Tingley | 219/10.55 D |
| 3,584,177 | 6/1971 | Buckbaum | 219/10.55 D |
| 3,629,537 | 12/1971 | Haagensen | 219/10.55 D |
| 3,633,564 | 1/1972 | Togashi et al. | 219/10.55 D |
| 3,668,357 | 6/1972 | Kobayashi | 219/10.55 D |
| 3,678,238 | 7/1972 | Yasuoka et al. | 219/10.55 D |
| 3,767,884 | 10/1973 | Osepchuk | 219/10.55 D |
| 3,803,377 | 4/1974 | Nakano | 219/10.55 D |
| 3,808,391 | 4/1974 | Graff et al. | 219/10.55 D |
| 3,809,843 | 5/1974 | Takayama | 219/10.55 D |
| 3,835,283 | 9/1974 | Sazuki | 219/10.55 D |
| 3,846,608 | 11/1974 | Valles | 219/10.55 D |
| 3,879,595 | 4/1975 | Lamb | 219/10.55 D |
| 3,985,993 | 10/1976 | Imberg et al. | 219/10.55 D |
| 4,013,861 | 3/1977 | Westfall | 219/10.55 D |
| 4,053,731 | 10/1977 | Foerstner | 219/10.55 D |
| 4,059,742 | 11/1977 | Baron | 219/10.55 D |
| 4,081,647 | 3/1978 | Torrey | 219/10.55 D |

*Primary Examiner*—Arthur T. Grimley

*Attorney, Agent, or Firm*—Wegner, Stellman, McCord, Wiles & Wood

[57] ABSTRACT

A microwave generating device includes a cabinet defining a cavity provided with an opening with an edge portion of the cabinet defining the periphery of the opening. A closure impervious to microwave energy extends removably across the opening and includes a peripheral portion overlying the cabinet edge portion. Structure is provided for preventing loss of microwave energy outwardly between the closure peripheral portion and the cabinet opening edge portion including cooperating surface portions on the closure peripheral portion and cabinet opening edge portion facially juxtaposed when the closure is disposed across the opening to define a capacitive seal against transmission of microwave energy outwardly therebetween. A metallic frame extends about the closure peripheral portion and includes a recess opening toward the capacitive seal to define a wave trap having a length preselected to be effectively one-quarter the wavelength of the microwave energy. An electrically conductive seal embraces the closure peripheral portion within the frame. A microwave energy seal is provided between the frame and the cabinet opening edge portion outwardly of the capacitive seal, and means defining a radiator in centered relationship to the wave trap recess of the frame is also provided. A second capacitive seal may be provided between the frame and the cabinet edge portion outwardly of the first capacitive seal and inwardly adjacent the outer microwave energy seal.

32 Claims, 5 Drawing Figures

FIG. 1
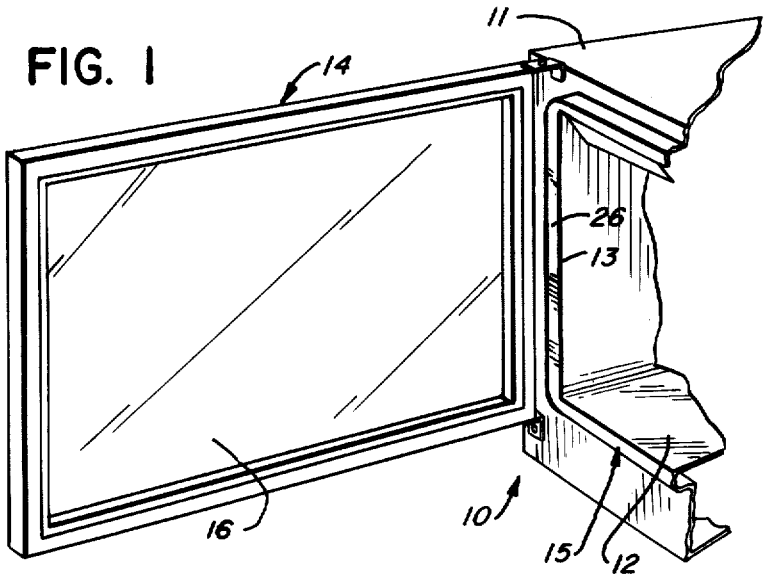
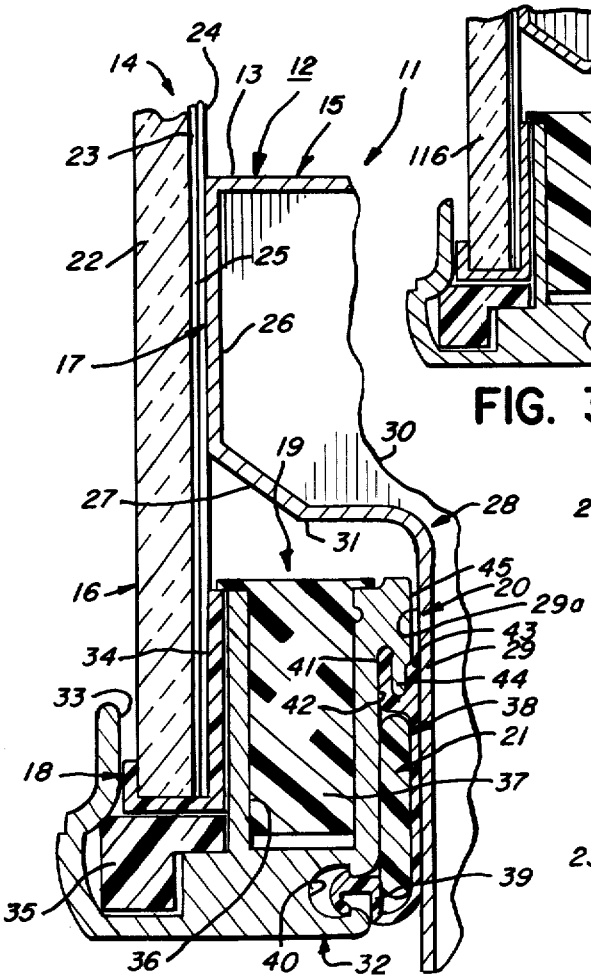
FIG. 2
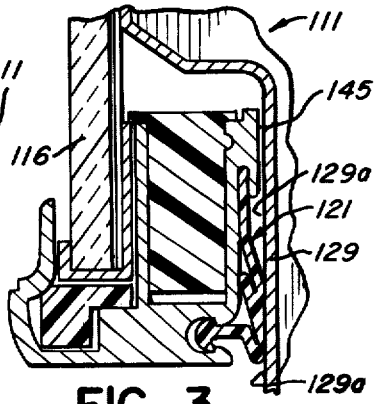
FIG. 3
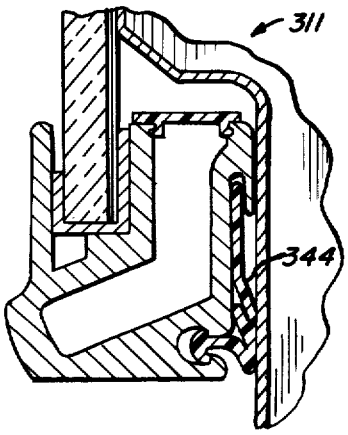
FIG. 5
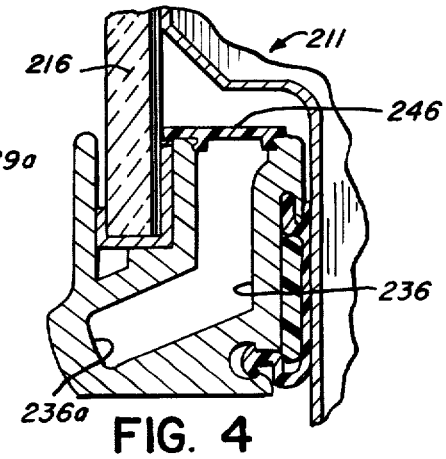
FIG. 4

MICROWAVE GENERATING DEVICE—DOOR SEAL

BACKGROUND OF THE INVENTION

1. Field of the Invention

This invention relates to microwave generating devices and in particular to door seals for use in such devices.

2. Description of the Prior Art

Louis H. Schall, in U.S. Pat. No. 2,956,143, shows a microwave oven wherein the door comprises a flat sheet metal plate to completely close the access opening with marginal overlap contact area for providing an electrical shield against the loss of microwave energy from the oven. In one form, the door seal includes a conductive rubber seal adhesively secured to the wall seat. A series arrangement of seals is provided so that the second seal may dissipate energy leaking past the first seal.

Takeshi Takayama, in U.S. Pat. No. 3,809,843, shows a microwave heating apparatus wherein each of the oven enclosure and the door are provided with complementary stepped structure defining a pair of planes. One of the stepped structures is formed with a cavity having a plurality of walls and a terminating wall. That stepped structure has an opening opposite to the step portion of the other stepped structure. The terminating wall of the cavity is spaced substantially ¼ wavelength from the middle point intermediate the step portion and the opening and is spaced an integral multiple of ½ wavelength from the boundary of the oven interior. A wave absorber is provided comprising rubber material blended with ferrite to absorb any adjacently existing wave without directly blocking the wave path. Thus, the Takayama patent teaches the provision of a door structure which prevents leakage of electromagnetic waves not only in the closed position of the door, but also when the door is slightly spaced from its closed position. The sealing means provides a plurality of seals in sequence along the direction of escape of electromagnetic energy.

John T. Lamb, in U.S. Pat. No. 3,879,595, shows a microwave oven door seal having primary, secondary, and tertiary radiation seals. The primary radiation seal may be capacitive and may be formed between the oven body and the hinged oven door. The secondary radiation seal may be absorbent and may be provided in the door about the access opening. The tertiary radiation seal may be absorbent and mounted in the oven body about the access opening except proximate the hinged edge of the door where the hinge itself is utilized to form the tertiary seal.

A number of other patents disclose a number of similar microwave oven door seals. Illustratively, in U.S. Pat. No. 3,196,242, of Peke J. De Vries et al, a high-frequency oven door seal is disclosed wherein the sealing frame adjoining the feed aperture consists of metal and the following sealing frame consists of a dielectric material in which is distributed a powdered substance which absorbs ultra high-frequency oscillations.

Louis H. Schall, in U.S. Pat. No. 3,196,243, shows a high frequency heating system having a closure door comprising a slotted outer shell enclosing a first removable window means, a second removable window means, and a third perforated metallic window means.

Paul W. Crapuchettes, in U.S. Pat. No. 3,242,303, shows a microwave heating apparatus wherein the boundary of the door overlaps an area of the front wall of the cabinet when the door is in the closed position with the width of this area being equal to a quarter wavelength of the second harmonic frequency of the electromagnetic wave energy supplied to the oven.

George B. Long, in U.S. Pat. No. 3,304,401, shows a microwave oven door closure wherein a shield member includes an imperforate flange overlying a collar on the oven structure defining the opening thereto whereby, when the door is closed, the flange portion of the core will engage the collar to prevent leakage of microwave energy from the interior of the oven around the outer edge of the door closure assembly.

Duane B. Haagensen et al, in U.S. Pat. No. 3,525,841, show a door seal for microwave ovens which includes a first cavity and a second cavity for attenuating and absorbing electromagnetic energy, respectively. Spacers are provided at the four corners of the door to ensure that a proper gap is maintained between the interior surface of the door and corresponding surfaces of the oven housing.

Benjamin V. Valles, in U.S. Pat. No. 3,544,751, shows a microwave oven having meshing microwave door seals. An elongated strip portion formed from and recessed from the oven walls surrounds the oven opening, and the oven door includes an inwardly projecting rim portion which fits within the recess and overlaps substantially the elongated strip portion when the door is in the closed position. A conductive surface of the door overlapping the elongated strip portion with the door closed extends about the inner surface of the oven door spaced inwardly from the rim. This forms a channel between the conductive surface and the rim within which the elongated strip projects when the door is in the closed position. A narrow lining of dielectric is positioned between the conductive surface and the elongated strip, and an attenuative material is positioned between the elongated strip and the rim.

Egbert M. Tingley, in U.S. Pat. No. 3,576,417, shows a construction for electronic oven appliances wherein the escape of microwave energy is prevented by providing inturned flanges for the sidewalls, component tray, and oven floor portions; and the oven door is sealed by means of a compressible annular metallic seal providing a continuous electrical connection between the door and door frame.

In U.S. Pat. No. 3,584,177 of Arnold M. Bucksbaum, an energy seal for microwave oven apparatus is shown as provided along peripheral walls of the door and comprising a short-circuited one-quarter wavelength-type choke structure. The structure is provided with a layer of conductive material adjacent to the wall surfaces to form substantially a double wall and supporting the high leakage currents as a result of the escaping radiated energy to thereby enhance the efficiency of the choke under all operating conditions.

Duane Buford Haagensen, in U.S. Pat. No. 3,629,537, shows a microwave oven door seal having dual cavities fed by a biplanar transmission line. The seal includes a biplanar transmission line which extends in a first direction from within the heating cavity to a point outside the heating cavity. At such point, the biplanar transmission line turns and extends in a second direction away from the access opening. A first electromagnetic wave filter is fed by the first portion of the biplanar transmission line and a second electromagnetic wave filter is fed by the second portion of the biplanar transmission line for reducing the amount of electromagnetic wave energy leaking from the heating cavity. The filters comprise cavities which are located along the biplanar transmission line. The cavities are designed to occupy a minimum of space to provide space for an observation window in the door. Both the width and length of the first portion of the biplanar transmission line on one side of the cavity decrease so that the sealing characteristics thereof remain relatively constant during initial opening movement of the door.

Tetsuo Togashi et al, in U.S. Pat. No. 3,633,564, shows a high-frequency sealing device provided with a hollow metal door having a resilient inner surface for leakageproof contact with the inner edges of the open end of the chamber. Radiation is directed through the hollow interior of the door through an elongated window provided on the inner surface thereof. The door may contain a dielectric for absorption of the leaking wave and its window may be permanently closed with a dielectric, thereby to prevent the entrance of any extraneous matter into the door interior without rendering the window itself impervious to the leaking wave.

In U.S. Pat. No. 3,668,357, Kyozo Kobayashi discloses a microwave seal for electronic range comprising a choke coupling-type microwave cavity communicating with a clearance between a range main body and a door in addition to a microwave seal. The microwave cavity serves to choke the second harmonic frequency component of electrowave energy to prevent the same from leaking from the range while the microwave seal serves to prevent the basic frequency component from leaking.

John M. Osepchuk et al, in U.S. Pat. No. 3,767,884, show an energy seal for high frequency energy apparatus comprising an energy absorbing gasket surrounding the seal to absorb any energy passing outwardly from the energy seal.

In U.S. Pat. No. 3,835,283, Ryuji Suzuki shows a partition and front wall forming choke structure for a microwave oven wherein the seal comprises a first electromagnetic wave labyrinth which is approximately equal in total length to an integral times a half-wavelength of the fundamental wavelength and a second electromagnetic labyrinth which is approximately equal in total length to an odd number of times the quarter-wavelength of the fundamental wavelength.

Michiyo Nakano, in U.S. Pat. No. 3,803,377, shows a microwave oven having combined multiple sealing means. A choke cavity is provided in the door, and a sash is provided on the oven housing which encompasses the door and mounts an absorbing material. An insulating coating separates an inner surface of the aluminum door liner from a corresponding surface of the housing, and a spacing is provided between the door and the surface of the absorbing material adjacent the door.

Bengt Uno Imberg et al, in U.S. Pat. No. 3,985,993, show a sealing arrangement for a microwave oven including a U-shaped door frame defining a quarter-wave choke, first and second seals each comprising an energy absorbent damping material, and a plurality of gaps between the door and the oven's cavity wall and front frame.

Thus, the prior art shows a large number of different types of door seals used in microwave generating devices, such as ovens. The door seals of the prior art are relatively complicated and expensive and have not been found to be fully satisfactory in providing the desirable microwave energy retention for oven devices.

SUMMARY OF THE INVENTION

The present invention comprehends a microwave generating device having improved means for sealing the closure door to the cabinet about the opening to the microwave cavity.

The disclosed closure door sealing means includes a primary capacitive seal, a reflecting gasket, a wave trap, a secondary capacitive seal, and an outer microwave energy seal which may comprise selectively a reflecting or an absorbing seal, as desired.

The invention further comprehends the selective use of either an air-filled wave trap or a filled wave trap, as desired.

The wave trap configuration is preselected to have a length effectively one-quarter the wavelength of the microwave energy.

The primary capacitive seal may have a length effectively one-quarter the wavelength of the microwave energy.

The capacitive seal may include a radiator portion aligned with the wave trap. In the illustrated embodiment, the capacitive seal includes a sharp break in the cabinet opening edge portion aligned with the wave trap.

The reflecting gasket may embrace the peripheral edge of the closure door panel and be received within a metallic frame member which further may define the wave trap.

The secondary capacitive seal may comprise confronting portions of the frame and cabinet opening edge portion. The frame may be spaced accurately from the cabinet portion and, in the illustrated embodiment, is so spaced by means of a retainer for mounting the outer microwave energy seal to the frame.

The seals cooperatively effectively prevent substantial loss of microwave energy outwardly between the closure peripheral portion and the cabinet opening edge portion with the capacitive seals and wave trap serving primarily to substantially prevent escape of such energy at the fundamental frequency and with the absorbing seals substantially preventing such energy escape over a wide band of frequencies.

The sealing means of the present invention is extremely simple and economical of construction while yet providing the highly improved sealing functioning discussed above.

BRIEF DESCRIPTION OF THE DRAWING

Other features and advantages of the invention will be apparent from the following description taken in connection with the accompanying drawing wherein:

FIG. 1 is a fragmentary perspective view of a microwave oven having improved sealing means embodying the invention;

FIG. 2 is a fragmentary enlarged vertical section of the sealing means thereof;

FIG. 3 is a fragmentary enlarged vertical section of a modified form of sealing means embodying the invention;

FIG. 4 is a fragmentary enlarged vertical section of another modified form of sealing means embodying the invention; and FIG. 5 is a fragmentary enlarged vertical section of yet another form of sealing means embodying the invention.

DESCRIPTION OF THE PREFERRED EMBODIMENTS

In the exemplary embodiment of the invention as disclosed in FIGS. 1 and 2 of the drawing, a microwave generating device generally designated 10 illustratively comprises a microwave oven having a cabinet 11 defining a cavity 12 provided with a front opening 13 selectively closed by a closure door generally designated 14. The door may be suitably movably mounted to the cabinet for selectively providing access to the cavity 12, as desired.

The cabinet includes an edge portion generally designated 15 defining the cavity opening 13 and the door includes a peripheral portion generally designated 16 overlapping the cabinet edge portion 15 when the door is in the closed position, such as shown in FIG. 2. The present invention is concerned with the provision of improved seal means for sealing the door peripheral portion 16 to the cabinet edge portion 15 so as to prevent undesirable loss of microwave energy outwardly from cavity 12 therebetween.

More specifically, the sealing means includes a first capacitive seal generally designated 17, a reflecting seal generally designated 18, a wave trap generally designated 19, a secondary capacitive seal generally designated 20, and an outer energy absorbing seal generally designated 21. In the embodiment of FIGS. 1 and 2, the outer seal 21 comprises an absorbing seal.

Closure door 14 may comprise a glass door panel 22 having a flame-sprayed aluminum coating 23 on the inside surface thereof and a protective inner coating 24 on the inside surface of the aluminum coating. The protective coating may comprise a layer of paint, or similar material, such as acrylic lacquer.

As will be apparent to those skilled in the art, the closure door panel portion may take a number of other forms, while yet functioning satisfactorily in conjunction with the present invention. For example, the door panel could comprise a thin sheet of metal with a perforated central area and a sheet of synthetic resin in place of the flame-sprayed coating 23 and the paint layer 24, respectively.

Cabinet 11 may be formed of painted metal, such as steel.

As seen in FIG. 2, capacitive seal 17 is defined by the confronting portion 25 of the aluminum coating 23 on the the door 14 and a planar portion 26 of the cabinet opening edge portion 15. Door portion 25 and cabinet portion 26 are effectively spaced apart by the dielectric paint or lacquer material therebetween so as to define the desired microwave energy capacitive seal.

In the illustrated embodiment, the length of the capacitive seal 17 outwardly from cavity 12 is preferably one-quarter the wavelength of the fundamental frequency of the microwave energy generated in cavity 12. In the illustrated embodiment, the wavelength of the microwave energy provided in cavity 12 was approximately 4.82" in air.

As further shown in FIG. 2, the cabinet opening edge portion 15 includes a midportion 27 extending angularly outwardly from the inner portion 26, and an outer portion generally designated 28 extending outwardly from midportion 27. The outer portion 28 includes a planar outer end 29 and an inturned inner end 30 connected to midportion 27 at a knee 31.

A frame 32 is provided comprising an aluminum extrusion. The frame includes a front inwardly opening recess 33 receiving the peripheral edge of the door panel of the door 14. A reflecting gasket 34 embraces the door edge within the recess 33 to define a reflective seal therein. More specifically, in the illustrated embodiment, the gasket 34 was formed of carbon-loaded vinyl synthetic resin. A plurality of rubber cushions 35 are provided at a plurality of locations about the door panel at the bottom of the recess 33 for firmly positioning the door panel in centered relationship with the frame.

The frame further defines a second recess 36 opening inwardly toward the cabinet edge portions 27 and 30. Recess 36 has a depth and width preselected to define a wave trap for the fundamental frequency microwave energy. In the illustrated embodiment, the knee 31, or break, in the cabinet opening edge portion 15 is centered inwardly from or over the wave trap recess 36 and functions in the manner of a radiator to provide improved wave trap functioning in combination with the capacitive seal 17. In the embodiment of FIG. 2, the recess 36 is filled with a suitable filler material, such as polyethylene, in the form of a plug 37. As shown therein, the plug extends partially to the bottom of the recess so that the distance from the knee 31 to the bottom of the recess, when considered with the characteristics of the polypropylene filler plug 37, effectively defines a distance of one-quarter of the wavelength of the fundamental wavelength of the microwave energy through the composite air and polypropylene portions of the path.

Outer seal 21, as indicated above, may comprise an absorbing seal and, in the illustrated embodiment, is formed of ferrite impregnated polyethylene chloride. The seal is enclosed in a retainer generally designated 38 having a first connecting portion 39 received in a recess 40 in the outer portion of frame 32, and a second connecting portion 41 received in a recess 42 in an inner portion of the frame.

The retainer further includes a flange 43 projecting inwardly to overlie a surface 44 on the frame facing toward the cabinet portion 29 and defining a thin wall spacing the frame surface 45 slightly inwardly from a surface **29*a* of the cabinet portion 29 to define a capacitive seal therewith. In the illustrated embodiment, the primary capacitive seal comprises seal 17 with the seal 20 defined by the confronting surfaces 45 and 29*a*** comprising a secondary seal.

Thus, in the present invention, the provision of a primary capacitive seal having a length approximately one-quarter the wavelength of the microwave energy being contained, and a wave trap having an effective length approximately one-quarter the wavelength of the microwave energy are provided in series to provide an improved seal of the oven door against such energy loss. The use of the supplementary reflecting, second capacitive, and absorbing seals provides further improved sealing between the door and the cabinet against such energy loss. The arrangement of the transition portion of the cabinet opening edge portion to define a radiator inwardly of the door panel and centered over the wave trap provides further improved sealing functioning.

Referring now to the embodiment of FIG. 3, a modified sealing structure is shown to be similar to that of the embodiment of FIGS. 1 and 2 but having a compressible reflective gasket generally designated 121 in lieu of the absorbing seal 21 of the previous embodiment. In this embodiment, the outer surface 145 of the frame is spaced from the cabinet portion 129 by the gasket 121 to define the secondary capacitive seal. The reflective seal 121 cooperates with the other seals of the structure to provide an improved sealing functioning generally similarly to that of the first disclosed embodiment.

In FIG. 3, the gasket 121 is shown in its free or uncompressed state for the purpose of clarity, but it should be understood that gasket 121 is compressible and would therefore be deformed and pressed against the rigid surface 129*a* of cabinet portion 129 when the door is in its closed position.

Referring now to the embodiment of FIG. 4, a further modified means for sealing the closure door to the oven is shown to comprise means similar to that of the embodiment of FIGS. 1 and 2 but having a modified recess 236 having a configuration suitable to define effectively one-quarter the wavelength of the fundamental frequency of the microwave energy in air. Recess 236 is unfilled but may be closed by a suitable cap 246 to prevent introduction of dirt and the like into the recess.

Because of the greater length of the recess 236 required by the fact that the wavelength of the microwave energy is greater in air than in polypropylene, the recess 236 is extended and includes an outer bottom portion 236*a* which extends to outwardly of the door peripheral portion 216.

In the embodiment of FIG. 5, a further modified seal construction is shown to comprise a seal construction generally similar to that of the embodiment of FIG. 4, but utilizing a reflective 344 similar to reflective seal 121 of the embodiment of FIG. 3 in lieu of the absorbing seal 21 of the embodiment of FIGS. 1 and 2. Again, the compressible seal 344 is shown for convenience in its undistorted cross section.

Thus, the seals illustrated in the embodiments of FIGS. 3, 4 and 5 function similarly to the seals of the embodiment of FIGS. 1 and 2 except as otherwise discussed above. In each of the different embodiments of the disclosed structures, the seals provide improved prevention of loss of microwave energy between the closure door and cabinet wall. In each of the different embodiments, the structure is extremely simple and economical while yet providing the improved sealing functioning.

The foregoing disclosure of specific embodiments is illustrative of the broad inventive concepts comprehended by the invention.

The embodiments of the invention in which an exclusive property or privilege is claimed are defined as follows:

1. In a microwave generating device having a cabinet defining a cavity provided with an opening with a front edge portion of the cabinet defining the outward periphery of the opening, a closure impervious to the microwave energy extending removably across said opening and having a peripheral portion forwardly overlying said cabinet edge portion, and means for generating microwave energy in the cavity, improved series and parallel related seal means for preventing loss of microwave energy outwardly between said closure peripheral portion and said cabinet opening edge portion comprising:

cooperating surface portions on said closure peripheral portion and said cabinet opening edge portion facially juxtaposed when said closure is disposed across said opening and defining a first capacitive seal against transmission of microwave energy outwardly from said cavity therebetween;

a metallic frame extending about said closure peripheral portion and having a recess opening inwardly toward said capacitive seal to define a wave trap having a length preselected to be effectively one-quarter the wavelength of the microwave energy;

a second capacitive seal outwardly of said wave trap;

an electrically conductive reflective seal embracing said closure peripheral portion within said frame and forwardly of said wave trap; and a microwave energy absorbing seal between said frame and said cabinet opening edge portion rearwardly of said wave trap and outwardly of said capacitive seal.

2. The microwave generating device of claim 1 wherein the length of the capacitive seal is preselected to be substantially one-quarter the wavelength of the microwave energy.

3. The microwave generating device of claim 1 wherein said microwave energy seal comprises a reflecting seal.

4. The microwave generating device of claim 1 wherein said microwave energy seal comprises an absorbing seal.

5. The microwave generating device of claim 1 including cooperating surface portions on said frame and said cabinet outer edge portion outwardly of said first named capacitive seal defining said secondary capacitive seal.

6. The microwave generating device of claim 1 wherein a body of filler material is provided in said recess.

7. The microwave generating device of claim 1 wherein a cover is mounted to said frame for covering said recess.

8. The microwave generating device of claim 1 wherein said electrically conductive seal is formed of carbon loaded synthetic resin material.

9. The microwave generating device of claim 1 wherein said microwave energy seal comprises an absorbing seal formed of ferrite-impregnated synthetic resin material.

10. The microwave generating device of claim 1 further including closely spaced cooperating surface portions on said frame and said cabinet outer edge portion outwardly of said first named capacitive seal defining a secondary capacitive seal.

11. The microwave generating device of claim 1 wherein said cooperating surface portions are closely spaced with a thin body of dielectric material disposed therebetween.

12. The microwave generating device of claim 1 wherein said cooperating surface portions are closely spaced with a thin body of dielectric material carried on said closure to be disposed therebetween.

13. The microwave generating device of claim 1 wherein said recess is straight.

14. The microwave generating device of claim 1 wherein said recess is turned.

15. The microwave generating device of claim 1 wherein said recess is turned to extend outwardly of said closure.

16. In a microwave generating device having a cabinet defining a cavity provided with an opening with a front edge portion of the cabinet defining the outward periphery of the opening, a closure impervious to the microwave energy extending removably across said opening and having a peripheral portion forwardly overlying said cabinet edge portion, and means for generating microwave energy in the cavity, improved series and parallel related seal means for preventing loss of microwave energy outwardly between said closure peripheral portion and said cabinet opening edge portion comprising:

a surface portion of said cabinet opening edge portion including a planar inner portion, an outwardly angled midportion, and an outer portion;

a cooperating planar inner portion on said closure peripheral portion facially juxtaposed to said cabinet outer edge portion planar inner portion when said closure is disposed across said opening and defining a capacitive seal against transmission of microwave energy outwardly from said cavity therebetween; and a metallic frame extending about said closure peripheral portion and having a recess rearwardly of said peripheral portion and opening inwardly toward said capacitive seal to define a wave trap having a length preselected to be effectively one-quarter the wavelength of the microwave energy, said frame being spaced outwardly from said cabinet opening edge portion outer portion and defining therewith a second capacitive seal outwardly of said first capacitive seal and rearwardly of said wave trap.

17. The microwave generating device of claim 16 wherein the juncture of said midportion and said outer portion of the cabinet opening edge portion defines a sharp break.

18. The microwave generating device of claim 16 wherein the juncture of said midportion and said outer portion of the cabinet opening edge portion defines a sharp break centered over the inner end of said recess.

19. The microwave generating device of claim 16 wherein said outer portion of the cabinet opening edge portion includes a planar outer end extending parallel to said inner portion, and a turned inner end extending substantially perpendicular to said outer end.

20. In a microwave generating device having a cabinet defining a cavity provided with a front opening with an edge portion of the cabinet defining the outward periphery of the opening, a closure impervious to the microwave energy extending removably across said opening and having a peripheral portion forwardly overlying said cabinet edge portion, and means for generating microwave energy in the cavity, improved means for preventing loss of microwave energy outwardly between said closure peripheral portion and said cabinet opening edge portion comprising:

a frame extending about said closure peripheral portion and defining a wave trap recess rearwardly of said peripheral portion and opening inwardly toward said cabinet opening edge portion; and means on said cabinet opening edge portion defining a localized radiator spaced inwardly of and in centered relationship to said wave trap recess.

21. The microwave generating device of claim 20 wherein a capacitive seal between said closure peripheral portion and cabinet opening edge portion is provided outwardly adjacent said radiator means.

22. The microwave generating device of claim 20 wherein a first capacitive seal between said closure peripheral portion and cabinet opening edge portion is provided inwardly adjacent said radiator means, and a second capacitive seal between said closure peripheral portion and cabinet opening edge portion is provided outwardly adjacent said radiator means.

23. The microwave generating device of claim 20 wherein said radiator means comprises a sharp break in said cabinet opening edge portion.

24. The microwave generating device of claim 20 wherein said recess is partially filled with filler material to cause the effective length of the wave path from the radiator to the bottom of the recess to be substantially one-quarter the wavelength of the microwave energy.

25. The microwave generating device of claim 20 wherein said recess is provided with a body of polypropylene and has a depth such that the spacing of said radiator from the bottom of the recess is substantially equal to one-quarter the wavelength of the microwave energy in the air and through the composite air and polypropylene path from the radiator to the bottom of the recess.

26. In a microwave generating device having a cabinet defining a cavity provided with a front opening with an edge portion of the cabinet defining the outward periphery of the opening, a closure impervious to the microwave energy extending removably across said opening and having a peripheral portion forwardly overlying said cabinet edge portion, and means for generating microwave energy in the cavity, improved cooperating energy absorbing and capacitive means for preventing loss of microwave energy outwardly between said closure peripheral portion and said cabinet opening edge portion comprising:

a metallic frame embracing the closure peripheral portion and having a surface portion juxtaposed to said cabinet opening edge portion;

a microwave energy absorbing seal; and a retainer for mounting said seal to said frame including a spacer portion extending between said frame and said cabinet opening edge portion for accurately spacing said frame surface portion forwardly from said cabinet opening edge portion to define a capacitive seal therewith.

27. The microwave generating device of claim 26 wherein said retainer is formed of synthetic resin material.

28. The microwave generating device of claim 26 wherein said retainer encloses said absorbing seal.

29. The microwave generating device of claim 26 wherein said spacer portion comprises an integral thin wall flange portion of said retainer.

30. In a microwave generating device having a cabinet defining a cavity provided with an opening with a front edge portion of the cabinet defining the outward periphery of the opening edge, said cabinet opening edge portion including a planar inner portion and an outer portion, a closure impervious to the microwave energy extending removably across said opening and having a peripheral portion forwardly overlying said planar inner portion of said cabinet edge portion, and means for generating microwave energy in the cavity, improved means for preventing loss of microwave energy outwardly between said closure peripheral portion and said cabinet opening edge portion comprising:

cooperating surface portions on said closure peripheral portion and said planar inner portion of said cabinet opening edge portion facially juxtaposed when said closure is disposed across said opening and defining a capacitive seal against transmission of microwave energy outwardly from said cavity therebetween;

a metallic frame extending about said closure peripheral portion and having a recess opening inwardly toward said capacitive seal to define a wave trap having a length generally parallel to said cooperating surface portions and preselected to be effectively one-quarter the wavelength of the microwave energy; and a microwave energy seal carried by said metallic frame and disposed between said frame and said outer portion of said cabinet opening edge portion outwardly of said capacitive seal and rearwardly of said wave trap when said closure is disposed across said opening.

31. The microwave generating device of claim 30 wherein said outer portion of said cabinet opening edge portion defines a planar portion generally parallel to said planar inner portion, and said microwave energy seal includes a corresponding surface inwardly adjacent said planar portion of said outer portion.

32. The microwave generating device of claim 30 wherein the cabinet opening edge portion includes an intermediate portion between said planar inner portion and said outer portion, and said intermediate portion defines a sharp break generally centered over said wave trap.

* * * * *